US006250939B1

(12) United States Patent
Chou

(10) Patent No.: US 6,250,939 B1
(45) Date of Patent: Jun. 26, 2001

(54) ADAPTER WITH DIVERSIFIED PLUGS AND RECTIFYING FUNCTION

(76) Inventor: Chin-Wen Chou, 4F, No. 42, Alley 30, Lane 284, Wu-Hsing Street, Taipei (TW)

( * ) Notice: Subject to any disclaimer, the term of this patent is extended or adjusted under 35 U.S.C. 154(b) by 0 days.

(21) Appl. No.: 09/584,536

(22) Filed: Jun. 1, 2000

(51) Int. Cl.[7] ..... H01R 29/00
(52) U.S. Cl. ..... 439/172; 439/956
(58) Field of Search ..... 439/172, 518, 439/956, 171, 694, 173, 289, 686, 700

(56) References Cited

U.S. PATENT DOCUMENTS 2,032,501 * 3/1936 Reynolds ..... 439/95
2,989,719 * 6/1961 Aarlaht ..... 439/103
4,518,212 * 5/1985 Rumble ..... 439/166
4,611,880 * 9/1986 Petersen et al. ..... 439/599
5,159,545 * 10/1992 Lee ..... 363/146
5,613,863 * 3/1997 Klaus et al. ..... 439/131
5,684,689 * 11/1997 Hahn ..... 439/172 X
5,851,123 * 12/1998 Chou ..... 439/172
5,938,459 * 8/1999 Lee et al. ..... 439/172
6,086,395 * 7/2000 Lloyd et al. ..... 439/172

* cited by examiner

*Primary Examiner*—Brian Sircus
*Assistant Examiner*—J. F. Doverne
(74) *Attorney, Agent, or Firm*—Bacon & Thomas, PLLC

(57) ABSTRACT

An adapter with diversified plugs and rectifying function. The adapter including a casing and a pivotally jointed cover. A penetration-disposing portion in a vacant lot of the casing is defined by a plurality of partition portions for setting differently sized plug pins. The adapter includes internally hollowed auxiliary pins or conductive members. In an outer rim of each of the partition portions, a first snap-retaining section is formed in association with an outer rim of the auxiliary pins or the plug pins. A circuit coupled with an external power cord and two conductive units connected to the circuit are built in the cover. One end of the conductive members can be depressed to contact an arbitrary set of the plug pins, and after the cover is closed, the conductive units are depressed to contact the conductive members to force the plug pins to be exposed through the penetration-disposing portions for coupling with an external power source.

7 Claims, 11 Drawing Sheets

PRIOR ART Fig. 1

ADAPTER WITH DIVERSIFIED PLUGS AND RECTIFYING FUNCTION

BACKGROUND OF THE INVENTION

1. Field of the Invention

This invention relates generally to adapters with diversified plugs, more particularly, it relates to an adapter with diversified plugs and rectifying function, wherein a plurality of auxiliary pins, replaceable plug pins, and a circuit are added to become compatible with various AC power sockets for voltage transformation and current rectification so as to provide a power supply for electric appliance.

2. Description of the Related Art

As illustrated in FIG. 1, a conventional adapter (Applicant's U.S. Pat. No. 5,851,123) contains a casing, wherein a plurality of plugging holes is arranged for accommodating a plurality of plug pins and conductive propping pins. The propping pins are used to prop and force the plug pins to penetrate through the plugging holes. A rear cover is jointed with one end of the casing so that one end of the propping pins can prop tightly against the rear cover while the other ends prop against the plug pins. A plurality of conductive members is disposed in the rear cover to contact with the conductive propping pins when the rear cover is closed to combine with the casing.

The abovesaid conventional adapter is designed to reduce the conversion problems between sockets of different specifications. However, such prior art adapters include the following drawbacks:

1. The foregoing adapter lacks the function of power rectification, transformation, and conversion even though it includes prepared diversified plug pins for replacement. To include such power functions, the user needs to carry with him/her an associated rectifier or voltage regulator.
2. The support strength is insufficient when the conductive members are depressed to prop against the conductive propping pins, hence, the conductive members are liable to get scratched or distorted, and further, as no positioning mechanism is available to limit the movement of the conductive propping pins, and short-circuits may be caused occasionally.
3. As the conductive members are directly coupled to a power cord of an electric appliance, the power cord may become partially stripped due to extensive rubbing or squeezing of the power cord and the cord may become ruptured eventually when the rear cover is repeatedly opened and closed for the replacement of different plug pins.
4. The bulky plug pins cannot be plugged deeply in a recessed wall socket. Although this may be improved by lengthening the plug pins, even after such modification, part of the plug pins will be exposed to the ambient air to increase the likelihood of shock and short circuits.

SUMMARY OF THE INVENTION

The primary object of this invention is to provide a penetration-disposing portion defined by a partition portion for setting differently sized plug pins, auxiliary pins or conductive members, and a segregation piece disposed between a casing and a cover for storing another set of conductive members or plug pins to associate with various sockets in different designs and for easy replacement of the plug pins.

Another object of this invention is to arrange in a vacant lot of a cover with a circuit coupled to an external power cord, and two conductive units connected to the circuit and located correspondingly above a plurality of penetration-disposing portions for introduction of an external power source through a plurality of conductive members and the conductive units to reach the circuit, which may be, but not necessarily be, a voltage regulator, a rectifier, a voltage boosting circuit, or a voltage descending circuit for treatment of the power source and output of an optimum power supply to thereby build an adapter with diversified plugs for current rectification, voltage transformation, or conversion purpose.

Yet another object of this invention is to form a first snap-retaining section in an outer rim of a partition portion for buckling with an auxiliary pin or a snap-joint portion of a plug pin, a second snap-retaining section arranged on an inner rim of the auxiliary pin for buckling with the snap-joint portion of the plug pin, and a segregation piece and an insulation piece so as to limit the plug pin and the auxiliary pin in a casing and prevent a plug pin, which is not depressed by a conductive member, from exposing to the air to avoid any electric shock; in addition, the insulation piece can support the conductive member and protect a conductive unit against distortion.

For more detailed information regarding this invention together with further advantages or features thereof, at least an example of preferred embodiment will be elucidated below with reference to the annexed drawings.

BRIEF DESCRIPTION OF THE DRAWINGS

The related drawings in connection with the detailed description of this invention, which is to be made later, are described briefly as follows, in which.

DETAILED DESCRIPTION OF THE PREFERRED EMBODIMENT

Figure 1:
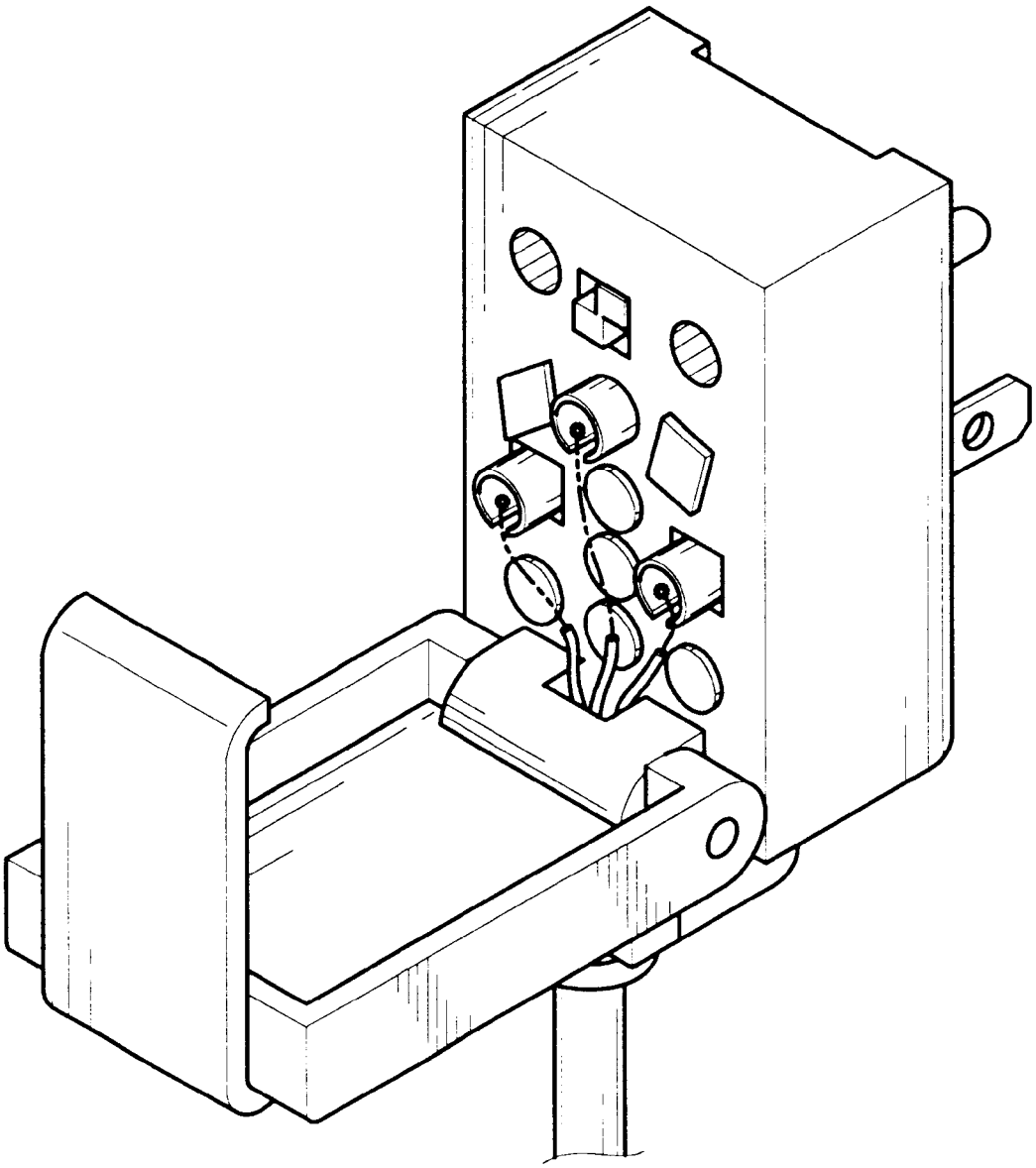
FIG. 1 is a perspective view of a conventional adapter.
Figure 2:
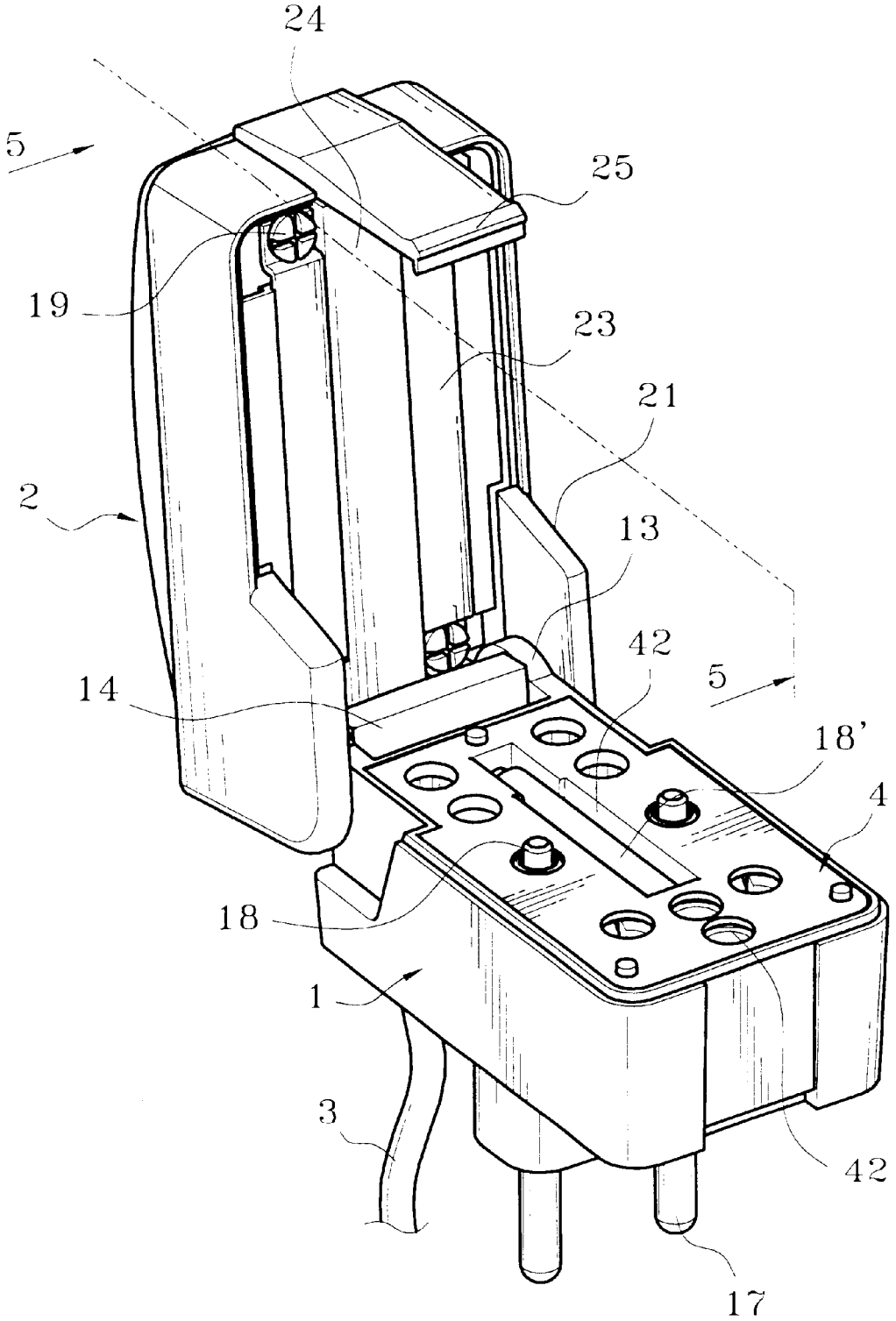
FIG. 2 is a perspective view of this invention.
Figure 3:
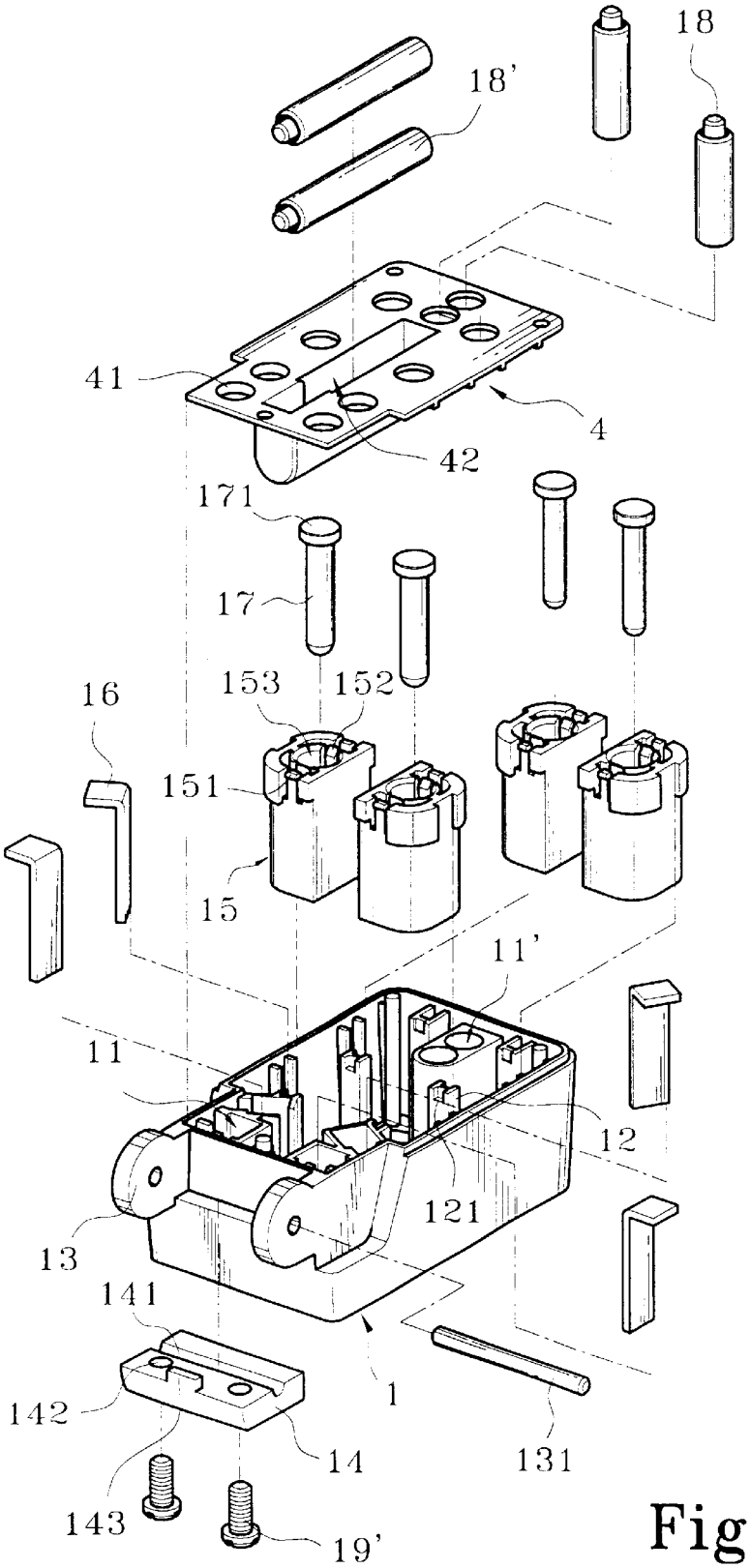
FIG. 3 is an exploded view of a casing of this invention.
Figure 4:
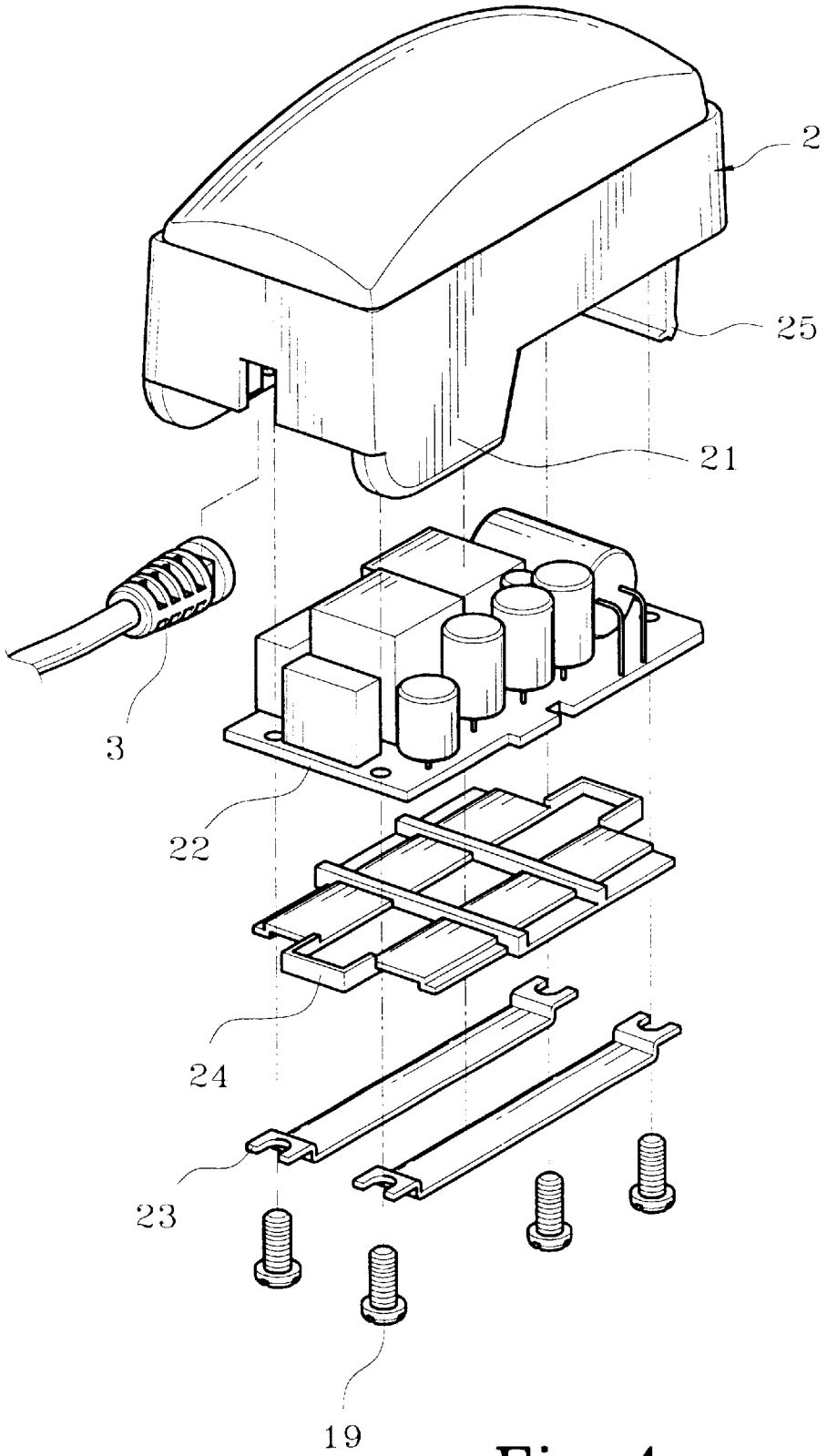
FIG. 4 is an exploded view of a cover of this invention.

As shown in FIGS. 2, 3, 4, an adapter with diversified plugs and rectifying function of this invention comprises a casing 1 and a cover 2 pivotally jointed to the casing 1. In a vacant lot of the casing 1, a penetration-disposing portion 11, 11' is defined by a plurality of partition portions 12 for setting a plurality of differently sized plug pins 16, 17, auxiliary pins 15 or conductive members 18, wherein the penetration-disposing portion 11 for setting the plug pin 16, 17 and the auxiliary pin 15 penetrates the casing 1 while the other one 11' for the conductive members 18 is opened at its top end; the top end of each of the plug pins 16, 17 is extended to form a snap-joint portion 171 respectively; in an outer rim of each of the partition portions 12, a first snap-retaining section 121 is formed in association with the auxiliary pins 15, or the snap-joint portions 171 of the plug pins 16, 17; a snap-ear 151 is disposed on an outer rim of the auxiliary pin 15 for snap-jointing to the first snap-retaining section 121; a second snap-retaining section 152 is arranged on an inner rim of the auxiliary pin 15 for buckling with the snap-joint portion 171 of the plug pin 16, 17; and one end of the casing 1 is extended to form a pair of pivot-joint ears 13.

Moreover, a pair of pivot-joint portions 21 is formed at one end of the cover 2 and pivotally jointed with the pivot-joint ears 13 by taking advantage of a pivot pin 131. A circuit 22 is coupled with an external power cord 3 and two conductive units 23 connected to the circuit 22 by using a plurality of fixing units 19 and located correspondingly above the penetration-disposing portions 11, 11' are built in the vacancy of the cover 2, wherein the circuit 22 may be a voltage regulator, a rectifier, a voltage boosting circuit, or a voltage descending circuit; and an insulation piece 24 is sandwiched between the conductive units 23 and the circuit 22. A snap-jointing portion 25 is formed at the other end of the cover 2 for being combinedly jointed with the casing 1, and a segregation piece 4 with a plurality of through holes 41 located correspondingly to the penetration-disposing portions 11, 11' with a diameter slightly shorter than that of the plug pins 16, 17 is arranged between the casing 1 and the cover 2, wherein a store trench 42 is formed in the segregation piece 4 for accommodating another set of conductive members 18' or the plug pins 16, 17 in different specifications. A positioning seat 14 having one end extended to form a retaining portion 143 for limiting the power cord 3 is disposed in the casing 1 between the pivot-joint ears 13 and fixedly jointed with one end of the cover 2 by using a plurality of fixing units 19' for pivotally jointing and positioning the cover 2 to the casing 1, wherein the positioning seat 14 is provided with a groove 141 for accommodating the pivot pin 131 and a plurality of jointing holes 142 for penetratingly fixing, the fixing units 19'.

Figure 5:
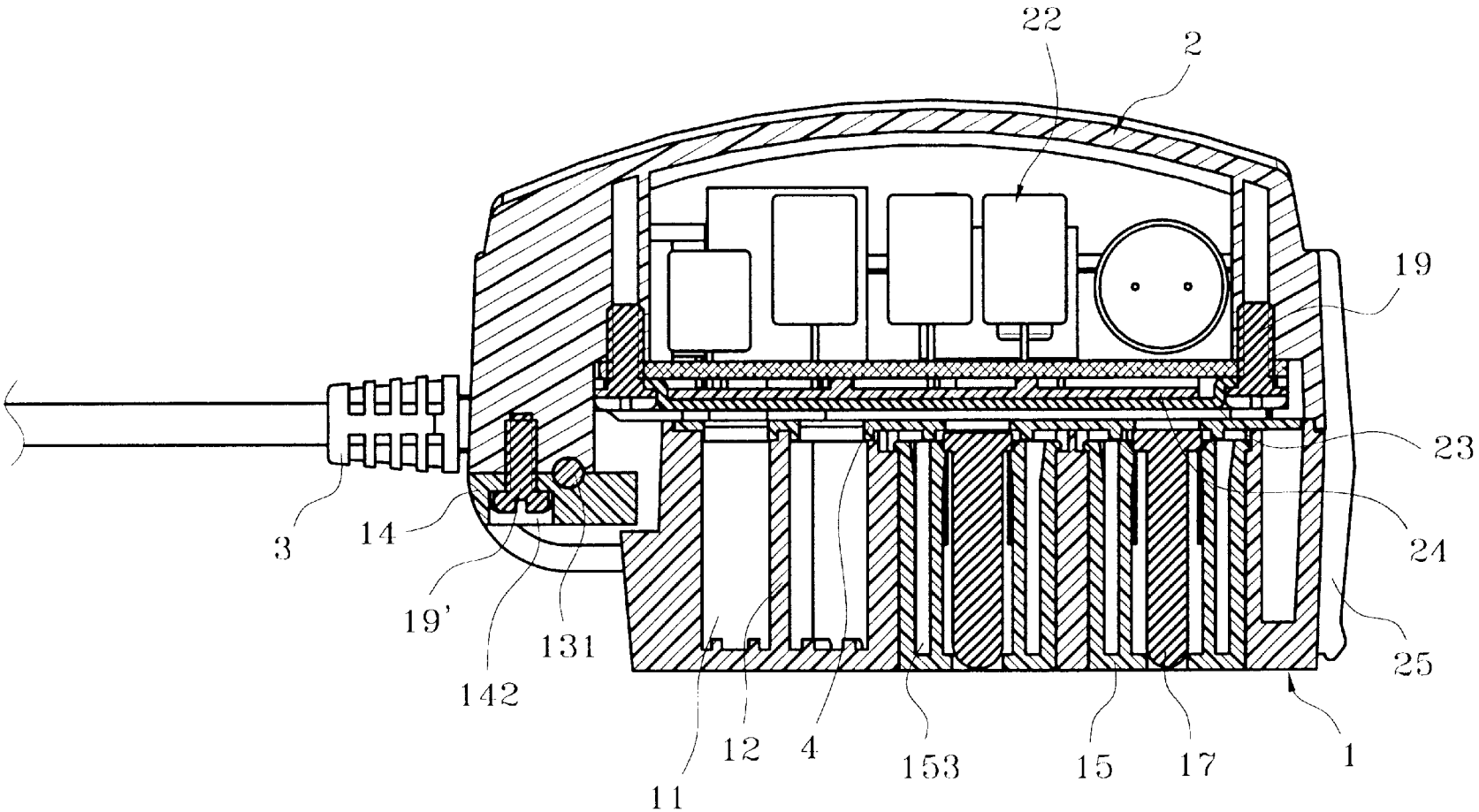
FIG. 5 is a cutaway sectional view taken along line 5—5 in FIG. 2.
Figure 6A:
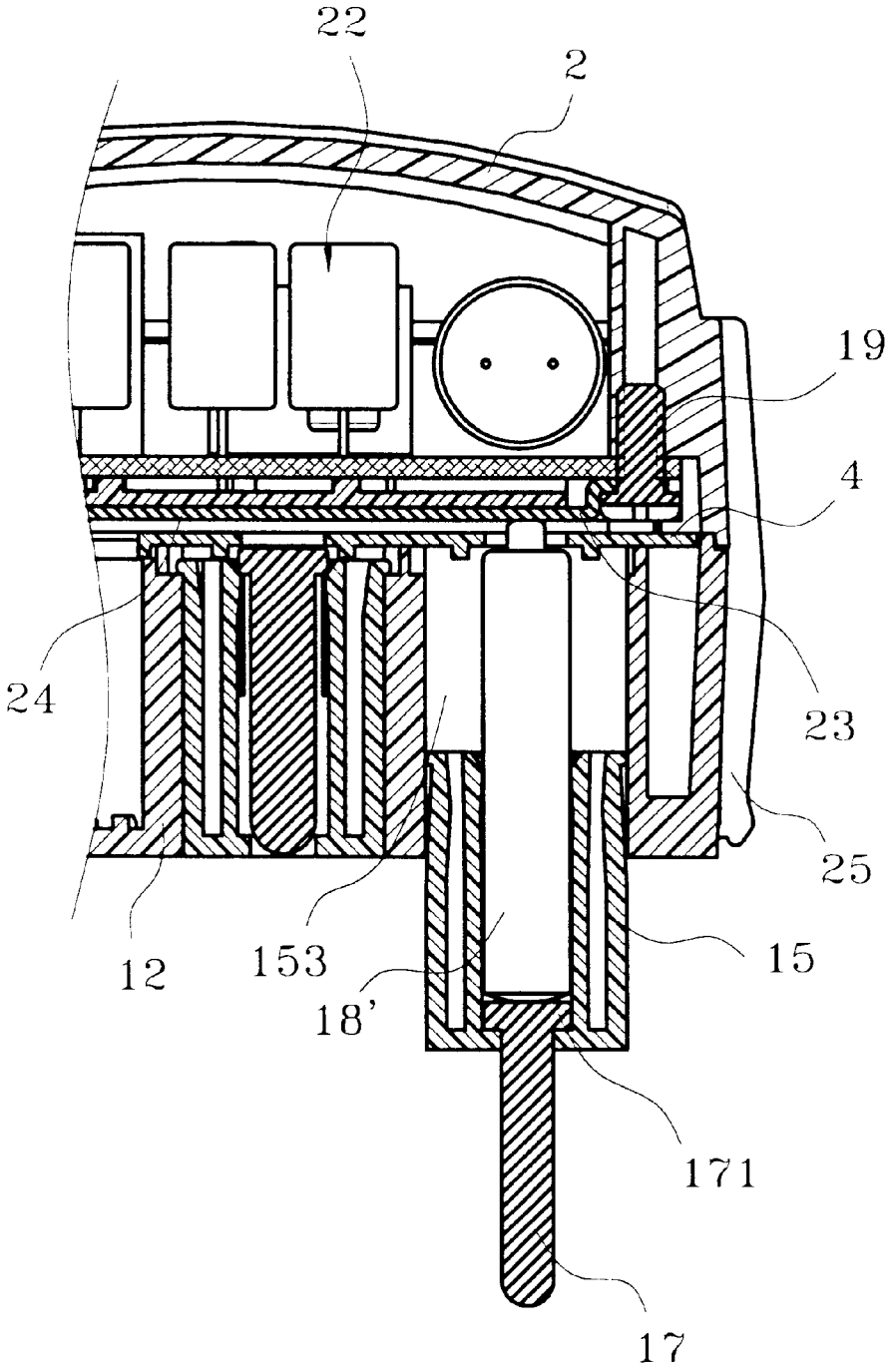
FIG. 6A and FIG. 6B show displacement of a plug pin of this invention.

Referring to FIG. 5 and FIG. 6A, when replacement of the plug pins 16, 17 in various specifications is desired, a user is requested to apply force to the snap-jointing portion 25 to open the cover 2, then place proper conductive members 18, 18' in the penetration-disposing portions 11, 11' or a plurality of store portions 153 in the internally hollowed auxiliary pins 15. Now, one end of the conductive, members 18, 18' can be depressed to contact an arbitrary set of the plug pins 16, 17, then the user is supposed to close the cover 2 so that the conductive units 23 are depressed to contact the other end of the conductive members 18, 18' and force the plug pins 16, 17 to expose to the air through the penetration-disposing portions 11, 11' for coupling with an external AC power. By abovesaid arrangement, the introduced AC power is conducted through the conductive members 18, 18' and the conductive units 23 to reach the circuit 22 for voltage transformation, current rectification, or conversion purpose in order to provide a DC power supply to be applied through the power cord 3.

Figure 6B:
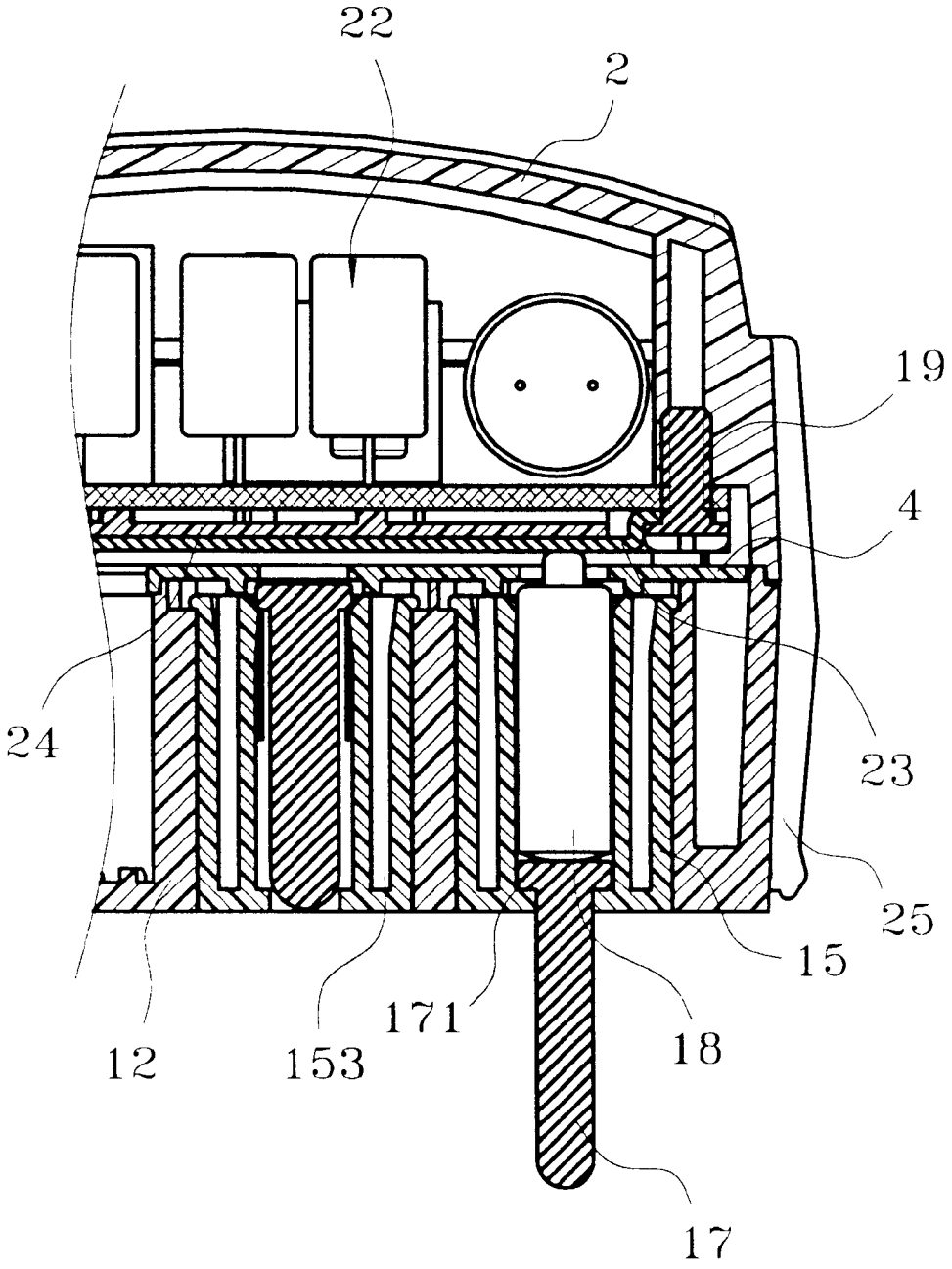
Figure 9:
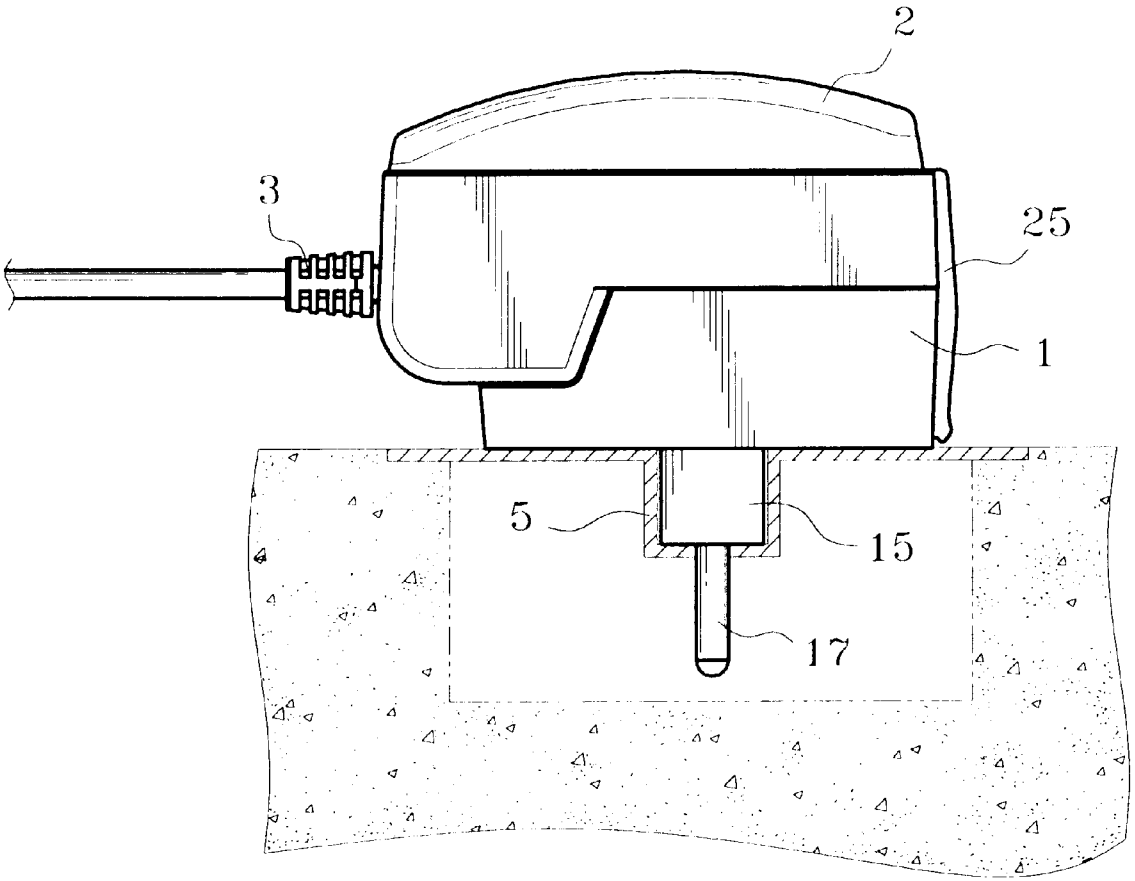
FIG. 9 is a schematic view showing that the plug pin of this invention is inserted in a recessed socket.

As shown in FIG. 6B and FIG. 9, in case of a recessed socket 5, because relatively longer conductive members 18' have been adopted and by taking advantage of the fact that the outer diameter of the snap-joint portion 171 at the top end of the plug pins 16, 17 is larger than the bore at the bottom end of the store portion 153 of the auxiliary pins 15, the plug pins 16, 17 can squeeze the auxiliary pins 15 to expose out of the penetration-disposing portions 11, 11' for being positioned in the recessed socket 5 so that the plug pins 16, 17 can be buried in the recessed socket 5 completely without worry of electrical shock.

Figure 7B:
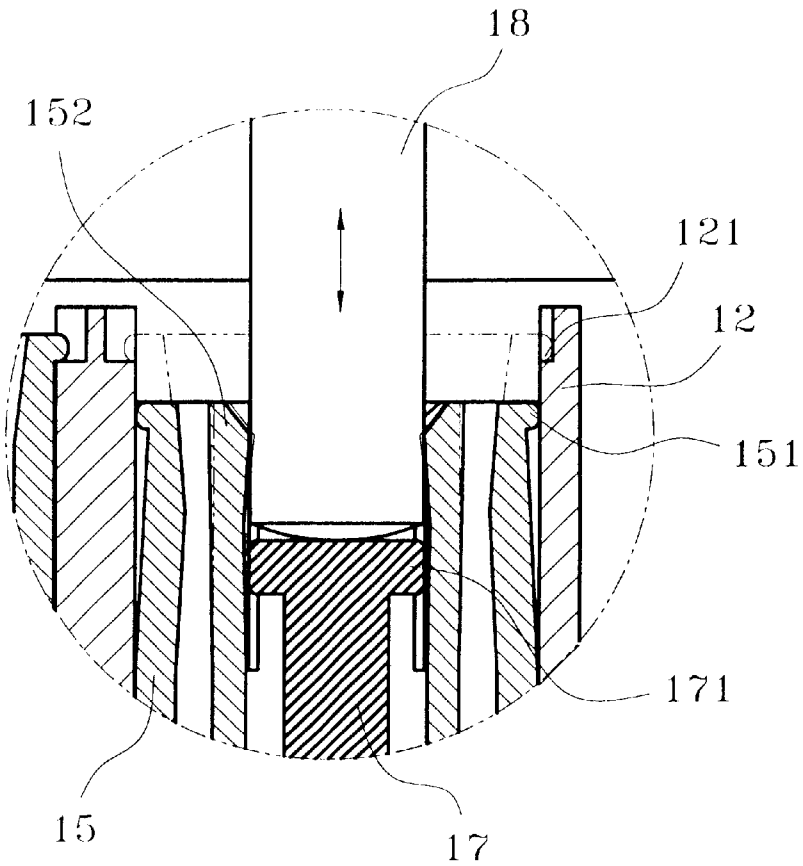
FIG. 7A and FIG. 7B show a snapped plug pin of this invention.
Figure 7A:
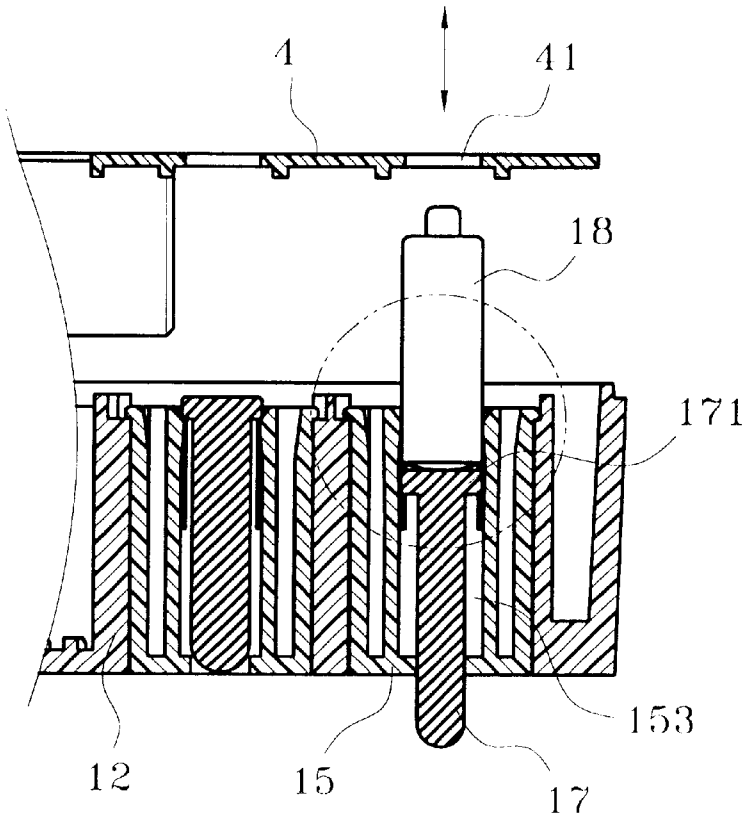
Figure 8A:
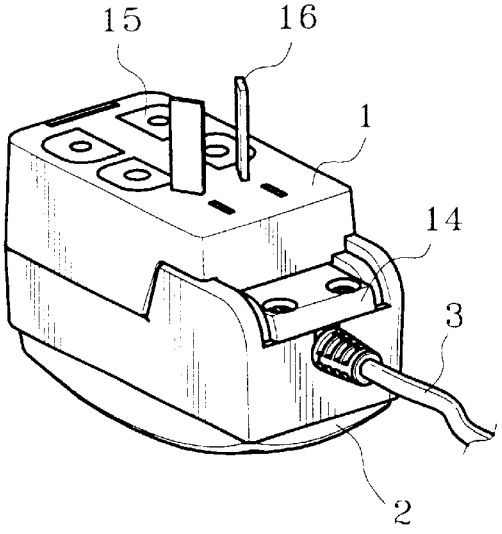
FIG. 8A through FIG. 8F show perspective views of examples of this invention with associated sockets in different specifications.
Figure 8B:
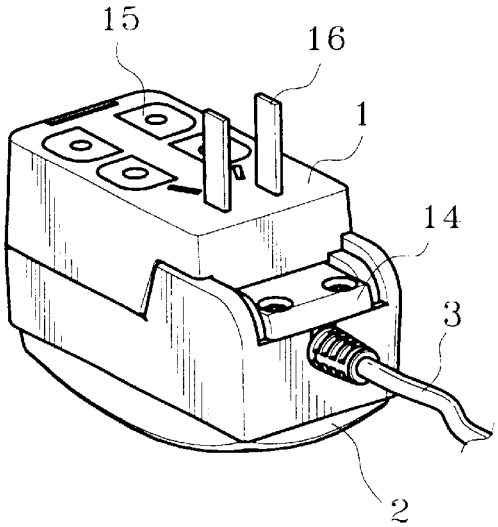
Figure 8C:
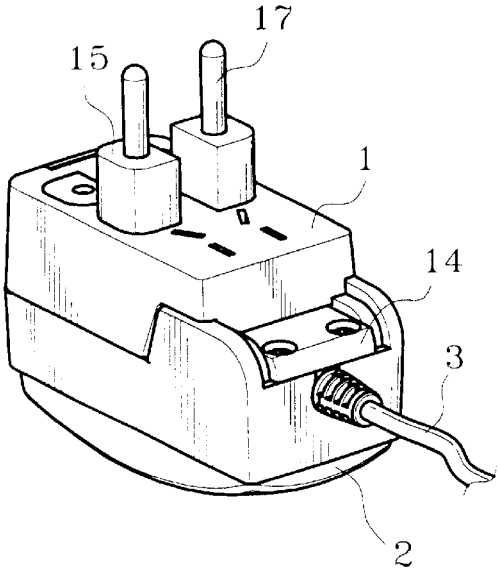
Figure 8D:
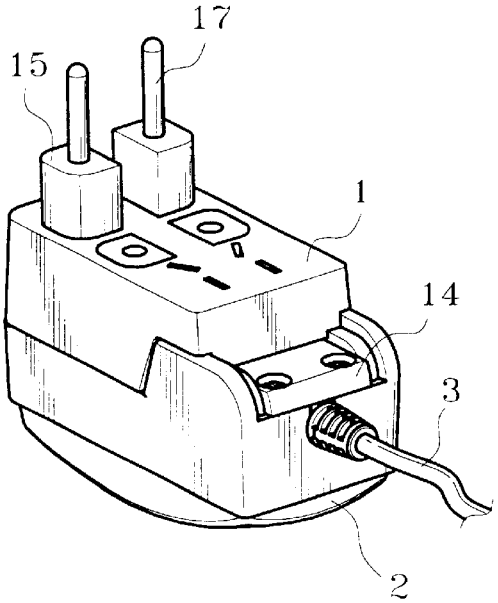
Figure 8E:
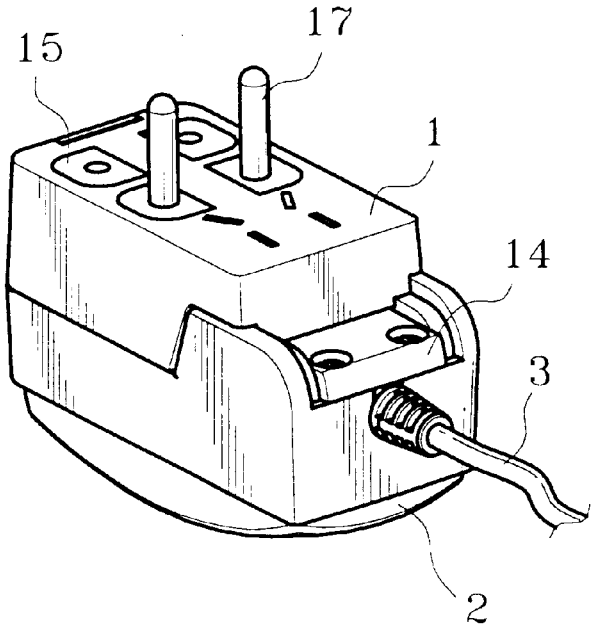
Figure 8F:
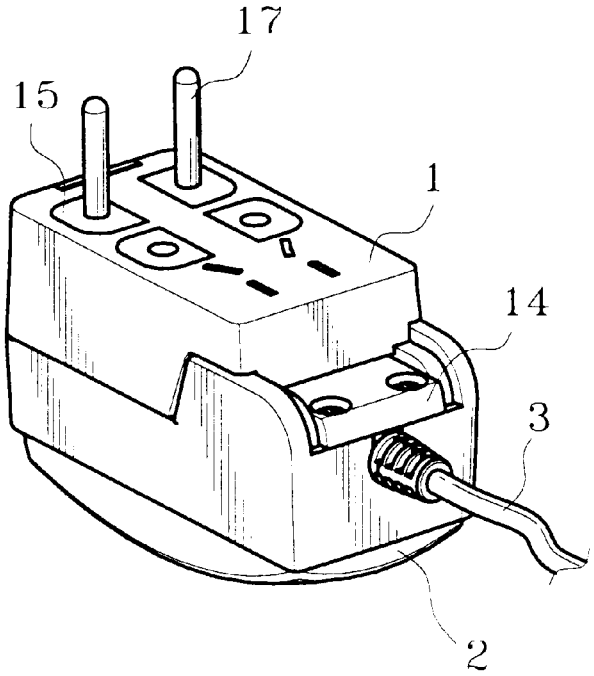

As illustrated in FIG. 7A and 7B—showing snapped plug pins 16, 17, and FIG. 8A through FIG. 8F—showing application examples of this invention—the plug pins 16, 17 and the penetration-disposing portions 11, 11' can be arranged in modules. When a proper set of the plug pins 16, 17 is selected, the plug pins 16, 17 that are not selected and the auxiliary pins 15 are prohibited from touching the conductive units 23 or moving downwardly to expose out of the penetration-disposing portions 11, 11' by the following measures: the through hole 41 being smaller than the outer diameter of the plug pin 16, 17 and the auxiliary pin 15; the first snap-retaining section 121 arranged peripherally around the partition portion 12 to cooperate with the snap-joint portion 171 of the plug pin 16, 17 and the auxiliary pin 15; the snap-ear 151 on the outer rim of the auxiliary pin 15 to be snap-jointed with the associated first snap-retaining section 121; and the second snap-retaining section 152 arranged in the inner rim of the auxiliary pin 15 to cooperate with the snap-joint portion 171 around the plug pin 16, 17. By abovesaid prevention measures, the unused plug pins 16, 17 and auxiliary pins 15 can be slightly moved upwardly by taking advantage of a slide-face guidance design of the first and the second snap-retaining section 121, 152 to have the snap-joint portion 171 of the plug pin 16, 17 or the snap-ear 151 of the auxiliary pin 15 fastened to the first and the second snap-retaining section 121, 152 in order not to move downwardly.

Although, this invention has been described in terms of preferred embodiments, it is apparent that numerous variations and modifications may be made without departing from the true spirit and scope thereof, as set forth in the following claims.

What is claimed is:

1. An adapter with diversified plugs and rectifying function, said adapter comprising:

a casing comprising a penetration-disposing portion, a plurality of partition portions secured in the casing and adapted to set a plurality of differently sized plug pins, internally hollowed auxiliary pins or conductive members, wherein a store portion is arranged in each of the auxiliary pins;

in an outer rim of each of the partition portions, a first snap-retaining section is formed in association with an outer rim of the auxiliary pins or the plug pins, a snap-ear is disposed in an outer rim of the auxiliary pin for snap-jointing to the first snap-retaining section;

one end of the casing is extended to form a pair of pivot-joint ears;

a cover comprising a pair of pivot-joint portions formed at one end and pivotally jointed with the pivot-joint ears of the casing by a pivot pin inserted through the pivot-joint ears and the pivot-joint portions, wherein a circuit coupled with an external power cord and two conductive units that are correspondingly positioned opposite the penetration-disposing portion of the casing and connected to the circuit are built in the cover;

a snap-jointing portion is formed at another end of the cover and adapted to detachably combine the cover to the casing; whereby one end of the conductive members is depressible in order to contact a predetermined set of the plug pins, and after the cover is closed, the conductive units are depressed to contact the conductive members to force the plug pins through the penetration-disposing portions so that the plug pins can be coupled with an external power source, power from which is then introduced through the conductive members and the conductive units to reach the circuit for voltage transformation, current rectification, or conversion purpose in order to provide an optimum power supply.

2. The adapter with diversified plugs and rectifying function according to claim 1, wherein a positioning seat is disposed in the casing between the pivot-joint ears, wherein a groove is formed in the positioning seat.

3. The adapter with diversified plugs and rectifying function according to claim 1, wherein a segregation piece having a plurality of through holes located correspondingly to the penetration-disposing portions is arranged between the casing and the cover, wherein a store trench is formed in the segregation piece for accommodating another set of conductive members or the plug pins in different specifications.

4. The adapter with diversified plugs and rectifying function according to claim 1, wherein an insulation piece is sandwiched between the conductive units and the circuit.

5. The adapter with diversified plugs and rectifying function according to claim 1, wherein the circuit is selected from the group consisting of a voltage regulator circuit, a rectifier circuit, a voltage boosting circuit and a voltage descending circuit.

6. The adapter with diversified plugs and rectifying function according to claim 1, wherein the snap-ear is disposed on an outer rim of the auxiliary pin for snap-jointing to the first snap-retaining section and a second snap-retaining section is arranged on an inner rim of the auxiliary pin in association with the plug pin.

7. The adapter with diversified plugs and rectifying function according to claim 1, wherein a top end of each set of the plug pins is extended to form a snap-joint portion.

* * * * *